US012203271B1

(12) United States Patent
Daniels

(10) Patent No.: US 12,203,271 B1
(45) Date of Patent: Jan. 21, 2025

(54) METAL ROOFING SYSTEM

(71) Applicant: Jim T. Daniels, Marion, MS (US)

(72) Inventor: Jim T. Daniels, Marion, MS (US)

( * ) Notice: Subject to any disclaimer, the term of this patent is extended or adjusted under 35 U.S.C. 154(b) by 110 days.

(21) Appl. No.: 17/941,786

(22) Filed: Sep. 9, 2022

(51) Int. Cl.
*E04B 2/00* (2006.01)
*E04D 3/30* (2006.01)
*E04D 3/365* (2006.01)
*E04D 3/366* (2006.01)

(52) U.S. Cl.
CPC ..... *E04D 3/366* (2013.01); *E04D 3/30* (2013.01); *E04D 3/365* (2013.01)

(58) Field of Classification Search
CPC ..... E04D 3/366; E04D 3/30; E04D 3/365
See application file for complete search history.

(56) References Cited

U.S. PATENT DOCUMENTS 1,861,998 A 6/1932 Bennett
2,270,218 A * 1/1942 Palmer ..... E04C 2/322 52/542
3,377,759 A * 4/1968 Booth ..... E04B 2/58 52/630
3,392,500 A * 7/1968 Johnston ..... B61D 17/04 52/630
3,462,906 A * 8/1969 Schroyer ..... F16B 5/07 52/483.1
3,733,767 A * 5/1973 Craik ..... E04D 3/36 52/529
3,754,366 A * 8/1973 Jansson ..... E04D 3/30 52/553
3,792,560 A * 2/1974 Naylor ..... E04D 3/30 52/630
4,120,123 A * 10/1978 Knudson ..... E04B 1/3205 52/406.2
4,155,206 A * 5/1979 Player ..... E04D 3/30 52/522
4,307,553 A * 12/1981 Puckett ..... E04D 3/364 52/470
4,366,656 A * 1/1983 Simpson ..... E04D 3/366 52/395
4,453,349 A * 6/1984 Ryan ..... E04D 13/1643 52/630
4,674,240 A * 6/1987 Strausheim ..... A47F 5/0846 52/542
4,833,853 A * 5/1989 Deibele ..... E04D 5/143 52/410
4,882,889 A * 11/1989 Healy ..... E04B 5/40 52/630
4,923,348 A 5/1990 Carlozzo et al.
4,944,644 A 7/1990 Bell
5,419,666 A 5/1995 Best
5,479,753 A 1/1996 Williams
(Continued)

*Primary Examiner* — Basil S Katcheves

(57) ABSTRACT

Method and apparatus for a metal roofing system having a plurality of panels having overlapping edges forming a ridge wherein the ridge is covered by a snap-on cap wherein the cap has opposing legs which are resiliently biased toward each other and are shaped to precisely conform with the shape of the lower portion of the ridge so that the cap can be firmly and securely attached to the ridge. A plurality of screws are inserted through the apex of the ridge so as to attach the roofing panels to the roof of the building structure. An end cap is also provided as a sealing mechanism for the open ends of the ridges and ribs disposed between the ridges.

16 Claims, 5 Drawing Sheets

(56) References Cited

U.S. PATENT DOCUMENTS

| | | | | |
|---|---|---|---|---|
| 5,715,639 | A * | 2/1998 | Yamada | E04D 3/363 52/542 |
| 8,341,917 | B2 * | 1/2013 | Resso | F24S 10/75 52/302.1 |
| 2007/0199276 | A1 | 8/2007 | Duque | |
| 2009/0272060 | A1 * | 11/2009 | Lucchesi | E04F 13/0821 52/489.1 |

* cited by examiner

METAL ROOFING SYSTEM

BACKGROUND OF THE INVENTION

Field of the Invention

The present invention relates generally to roofs and the field of roofing and more particularly, is concerned with a metal roofing system having a cap placed over a ridge formed by overlapping edges of panels of the roofing system.

Description of the Related Art

Devices relevant to the present invention have been described in the related art; however, none of the related art devices disclose the unique features of the present invention.

In U.S. Pat. No. 4,307,553 dated Dec. 29, 1981, Puckett disclosed a seam for joining roof panels and a method therefor. In U.S. Pat. No. 4,944,644 dated Jul. 31, 1990, Bell disclosed a screw fastener cap. In U.S. Pat. No. 5,479,753 dated Jan. 2, 1996, Williams disclosed a process for sealing a sloped metal roof. In U.S. Pat. No. 1,861,998 dated Jun. 7, 1932, Bennett disclosed a sheet metal roofing system. In U.S. Patent Application Publication No. 2007/0199276 dated Aug. 30, 2007, Duque disclosed a self-sealing ring for a roofing nail. In U.S. Pat. No. 5,419,666 dated May 30, 1995, Best disclosed a protective waterproof cover assembly for covering a fastener. In U.S. Pat. No. 4,923,348 dated May 8, 1990, Carlozzo, et al., disclosed a protective cap structure and method therefor.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a metal roofing system having a plurality of panels having overlapping edges forming a ridge wherein the ridge is covered by a snap-on cap wherein the cap has opposing legs which are resiliently biased toward each other and are shaped to precisely conform with the shape of the lower portion of the ridge so that the cap can be firmly and securely attached to the ridge. A plurality of screws are inserted through the apex of the ridge so as to attach the roofing panels to the roof of the building structure. The purpose of the cap is to provide a sealing mechanism over the screws to prevent water leakage through the panels. An end cap is also provided as a sealing mechanism for the open ends of the ridges and ribs disposed between the ridges.

An object of the present invention is to provide a roofing system wherein the edges of the panels can be securely joined to each other so as to be water tight to prevent leakage of water into the underlying support structure. A further object of the present invention is to provide a roofing system having a cap covering the ridge where screws are placed in order to prevent the screws from leakage. A further object of the present invention is to provide a roofing system which can be easily operated by an installer of the roofing system. A further object of the present invention is to provide a roofing system which can be relatively easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
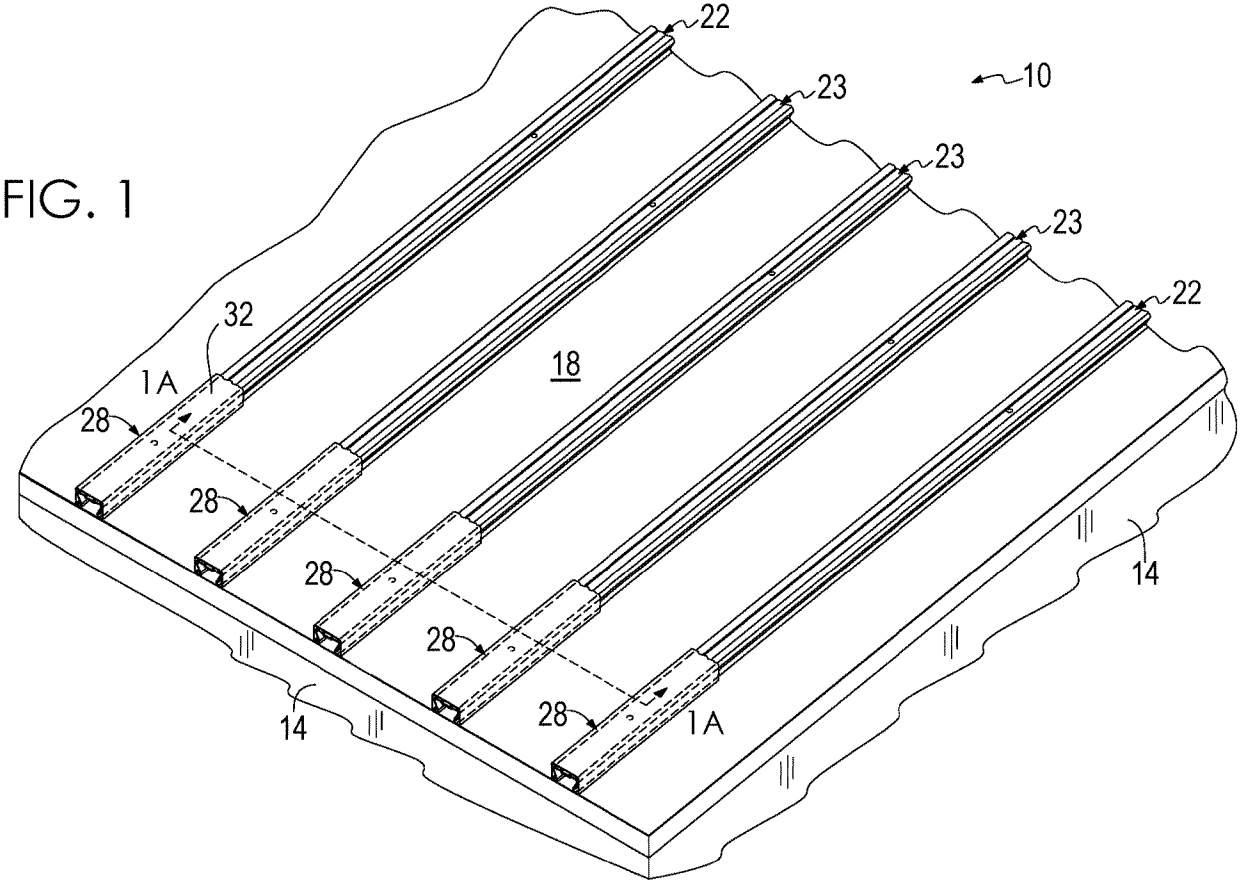
FIG. 1 is a perspective view of a panel of the present invention in operative connection on a building.

With regard to reference numerals used, the following numbering is used throughout the drawings.

10 present invention
12 metal roof
14 building
16 trusses or purlins
18 sheets/panels
19 right or first end of panel
20 screws or fasteners
21 left or second end of panel
22 ridge formed by joining edges of panels
23 ribs formed between ridges
24 adjacent sheets
25 top of rib
26 adjacent sheets
27 right leg of rib
28 cap
29 left leg of rib
30 hat cap
32 flat cap
34 oval cap
36 top of cap

38 right leg of cap
40 left leg of cap
42 right lower or distal end of right leg of cap
44 left lower or distal end of left leg of cap
45 inset (sometimes referred to as offset)
46 right curved end of leg inset of cap
48 left curved end of leg inset of cap
50 lower right leg
51 lower right foot
52 lower left leg
53 free end
54 raised portion
56 raised portion
57 free end
58 lower right leg
60 end cap
62 end wall
64 top wall
66 left wall
68 right wall

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 9 illustrate the present invention wherein a metal roofing system for a building is disclosed and which is generally indicated by reference number 10.

Turning to FIG. 1, therein is shown a panel 18 for use with the present invention 10 being disposed on an upper surface of a building 14 wherein the panel 18 having a first raised or upstanding ridge 22 on the left edge along with a second raised or upstanding ridge 22 on the right edge wherein the ridges 22 are formed by overlapping the edge of one panel 18 with the mating edge of another adjacent panel. Also shown disposed between ridges 22, are a plurality of raised or upstanding spaced apart ribs 23 wherein it is expected that three ribs (although it is possible a number different than three could be used) would normally be disposed between the left and right ridges 22. Also shown is a cap 28 disposed on each ridge 22 and rib 23.

Figure 1A:
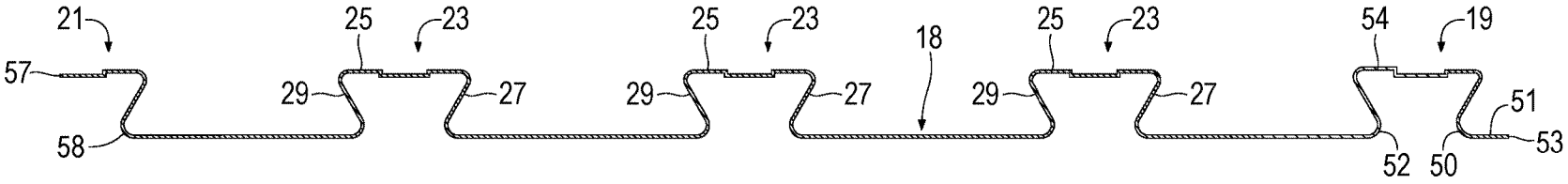
FIG. 1A is a cross section view of a panel of the present invention.

Turning to FIG. 1A, therein is shown a cross-sectional view of a single panel 18 of the present invention 10. Shown therein is a left edge 21 and a right edge 19 wherein the right edge 19 includes a raised portion 54 on the right edge of panel 18 having a downwardly extending lower right leg 50 and a lower right foot 51 which terminates as a free end 53 and also including a downwardly extending lower left leg 52. Also shown on the left edge 21 is a raised portion 56 of the left edge of the panel along with a downwardly extending lower right leg 58. A plurality of ribs 23 are spaced apart equally between the right edge 19 and the left edge 21 of the panel 18. The ribs 23 each have a top portion 25, a right leg 27, and a left leg 29. It can be seen that the left edge 21 has an upstanding portion 56 having a laterally extending horizontal projection to toward the left end which terminates in a free end 57. The right edge 19 has a lower right foot 51 which forms a laterally extending horizontal projection away from the right end 19 which provides a rigid vertical strengthening support to prevent crumpling when a screw is later inserted through its top.

Turning to FIGS. 2-5, therein is shown the present invention 10 mounted on a sloped metal roof 12 which is installed on a building 14 using metal or wood trusses and purlins 16 that run longitudinally along the length of the building. The metal roof 12 comprises a plurality of sheets 18 of relatively thin sheet metal sections that are attached with screws or fasteners 20 on the roof. The individual sheets are approximately 32" to 36" wide with variable length because they are custom cut to fit according to the particular application. The ridges 22, generally indicated by reference numeral 22, are formed by the joining overlapping edges of the panels 18, and the ridge 22 runs longitudinally in the sloped direction along the sheets 18 and is disposed on the overlapping edges of adjacent sheets 24, 26 through which fastener 20 is inserted. The ridge 22 is approximately 1 to 1¼ inches high and approximately 1½ inches wide and being tapered outwardly from the base to the top of the ridge so that the ridge 22 is wider at the top than the bottom. A ridge 22 would be disposed at the joining edge between each of the adjacent panels 24, 26 of the roof 12. The present invention 10 includes a cap, which is generally indicated by reference numeral 28, which is placed over each ridge 22 and rib 23. There are three types of caps including a hat cap 30, a flat cap 32, and an oval cap 34. A typical cap has a top section 36, a right leg or side 38, a left leg or side 40, a lower right end 42 and a lower left end 44 having a distally disposed inwardly projecting inset 45 with arcuate end 46 on the right and on the left 48 which is precisely shaped to mate to the lower right end or side 50 of the ridge 22 and the lower left end or side 52 of the ridge 22. Inset/offset 45 is substantially perpendicular to legs 38, 40 of cap 28. The length of the offset 45 is expected to range from about ⅛" to about ½" and be effectively long to securely and removably attach the cap 28 to the ridge 22. The convex curved oval or tear-drop shape of the legs 46, 48 conforms to the concave curved shape of the lower sides 50, 52 of the ridge 22 so that the cap 28 can be snapped into place; the lower sides 50, 52 form a receptacle for the legs 46, 48. The ends of the legs 46, 48 securely adhere the cap 28 to the ridge 22 so that no leakage occurs between the cap 28, screws 20, or ridge 22 because the outer surfaces of the legs 46, 48 are sized and shaped to directly contact and are resiliently biased to mate to the lower sides 50, 52 of the ridge 22. The legs 38, 40 are effectively biased toward each other an effective amount to securely and removably attach the cap 28 to the ridge 22 so that when a cap 28 is attached to a ridge 22 (or rib 23) the cap will snap securely into place. Legs 52, 58 form an acute angle relative to the horizontal plane of between 40 and 80 degrees and, more particularly, approximately 60 degrees. In operation, when the cap 28 is to be installed on a ridge 22 or rib 23, its legs 38, 40 would be initially deflected outwardly and then snapped into place so that the curved ends 46, 48 are disposed into the mating concave shaped receptacles formed at 50, 52 so as to be in a mechanical locking relationship with the ridges and ribs.

Figure 2:
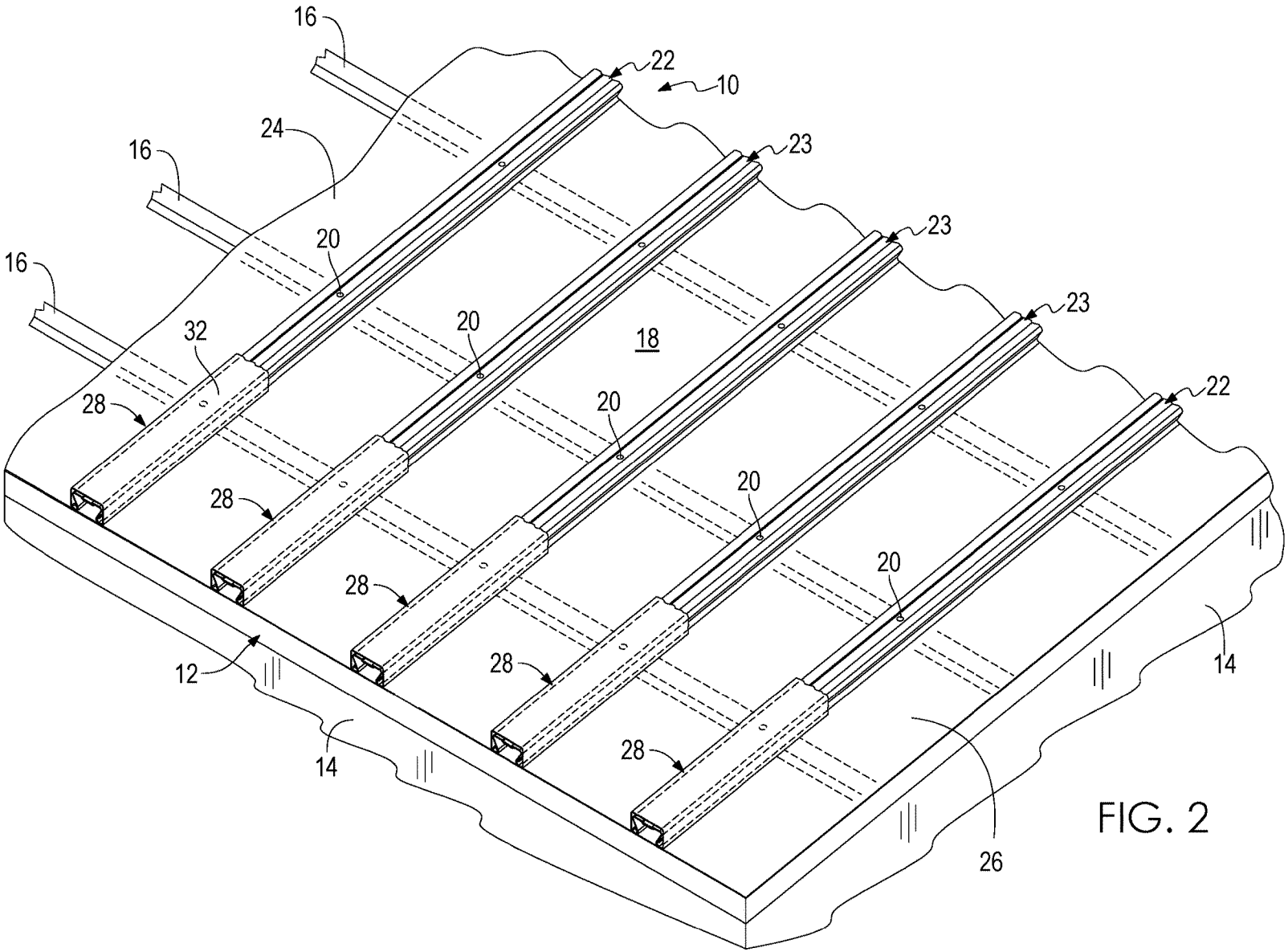
FIG. 2 is a perspective view of the present invention in operative connection on a building.
Figure 3:
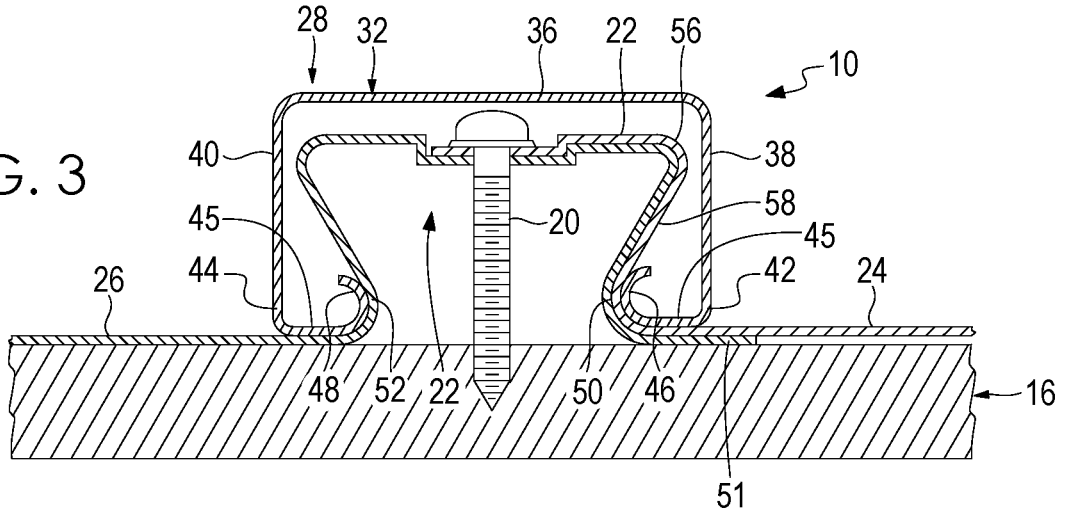
FIG. 3 is a cross section view of one embodiment of a cap of the present invention.
Figure 4:
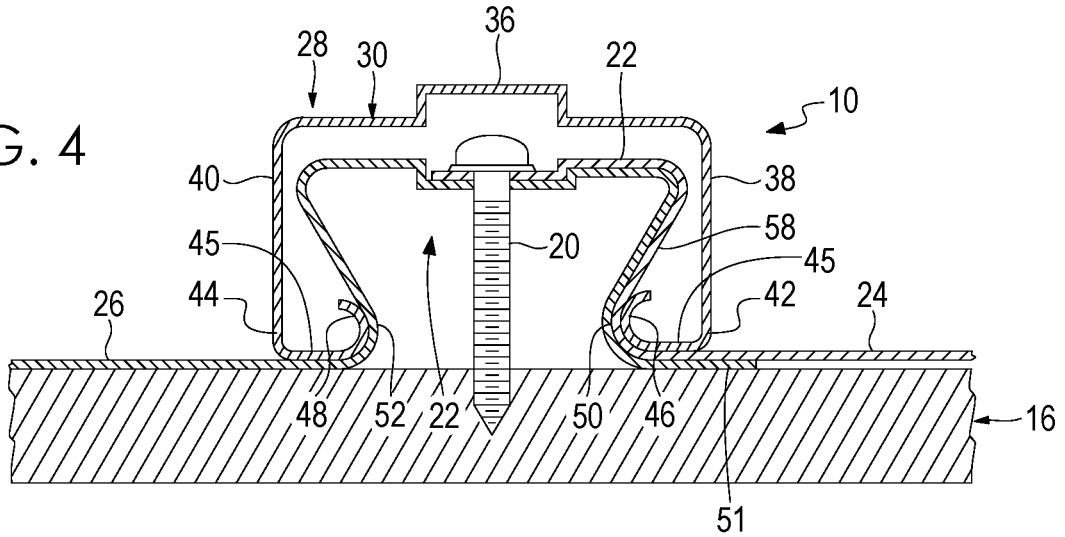
FIG. 4 is a cross section view of a second embodiment of a cap of the present invention.
Figure 5:
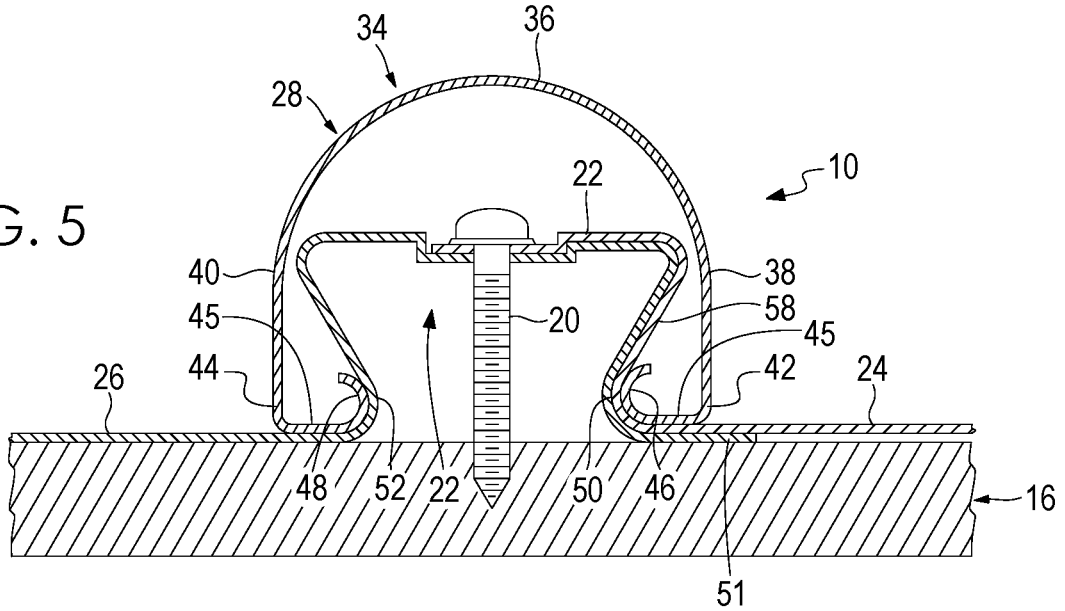
FIG. 5 is a cross section view of a third embodiment of a cap of the present invention.
Figure 6:
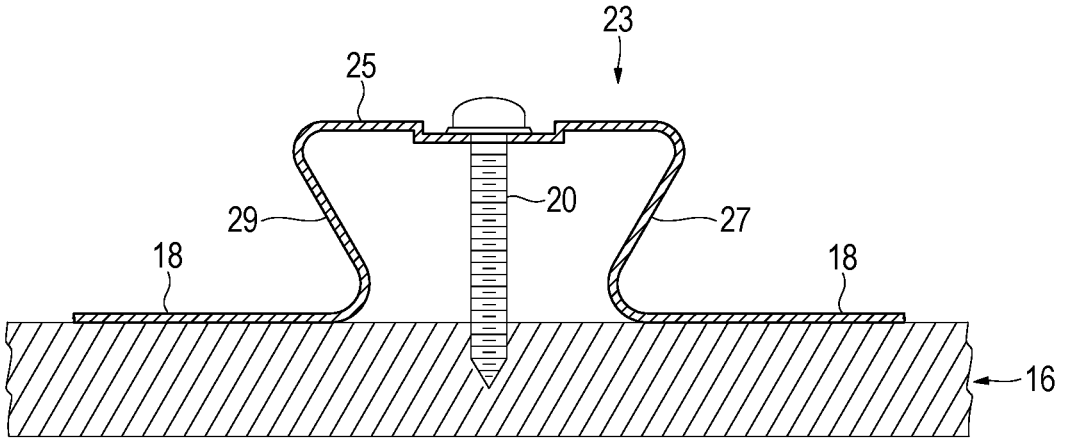
FIG. 6 is a cross section view of a rib of the present invention.

Turning to FIG. 6, therein is shown a cross-section view of a rib 23 being an upstanding rib portion of the panel 18 wherein the rib is located in a non-overlapping or flat portion of the panel 18 as shown in FIGS. 1, 1A, and 2. Each rib 23 has a top portion 25, a right leg portion 27, and a left leg portion 29. The ribs 23 have a cross-sectional shape similar to that of a ridge 22 and also have mating curved surfaces at the lower ends of the distal portion or distal end of the legs 27, 29 for receiving a cap 28 similarly to that disclosed relative to ridges 22 in FIGS. 3, 4, and 5. Rib 23 is shown mounted onto a part of the framework of a building such as a purlin 16.

Figure 8:
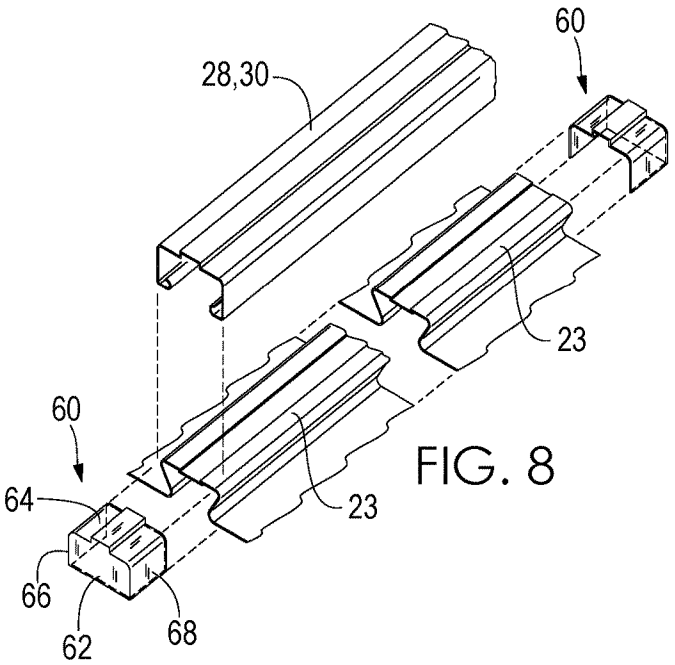
FIG. 8 is an exploded perspective view of a second embodiment of an end cap of the present invention.
Figure 7:
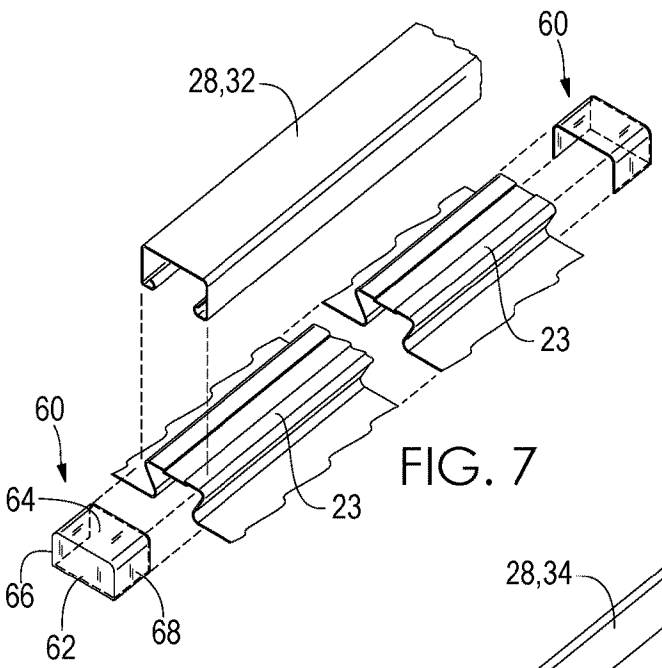
FIG. 7 is an exploded perspective view of one embodiment of an end cap of the present invention.
Figure 9:
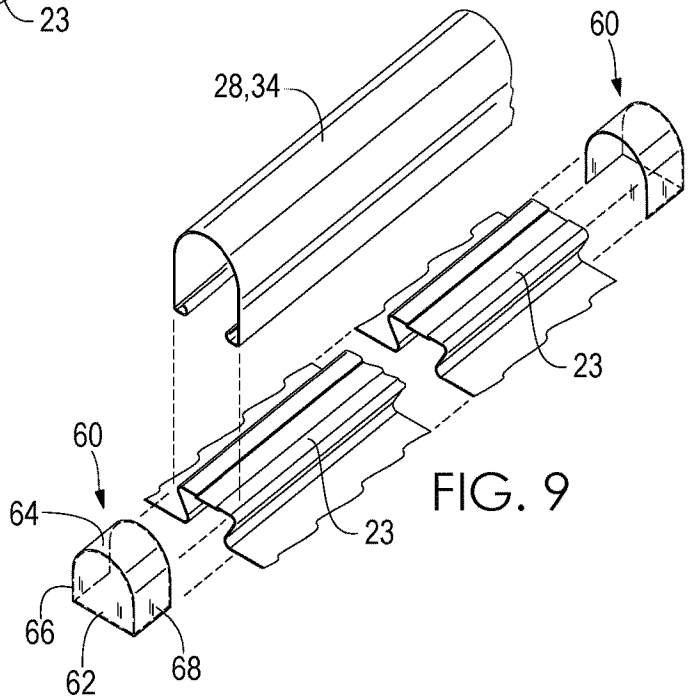
FIG. 9 is an exploded perspective view of a third embodiment of an end cap of the present invention.

Turning to FIGS. 7-9, therein is shown end caps, generally indicated by reference numeral 60, disposed on an open end of a rib 23. The end caps 60 are shaped to conform to the shape of a flat cap 32 in FIG. 7, the hat cap 30 of FIG. 8, and the oval cap 34 of FIG. 9. Each end cap 60 has an end wall 62, a top wall 64, a left side wall 66, and a right side wall 68 being open on its bottom and opposite end. The end caps 60 slide into the open ends of the ribs 23 and ridges 22 as the walls 66, 68 slide longitudinally along the rib 23 so that the walls and top of the end cap are disposed between the ridges 22 or ribs 23 and the caps 28. Each end cap 60 is slidably, removably disposed and secured on an open end of the ridges 22 and ribs 23 so that no ends are left open in order to prevent leakage of water into the ridges 22 and ribs 23.

It is known that metal roofs are lightweight and easy to install. The installation process of metal roofs involves placing the metal sheets 18 in a side-by-side relationship on the roof so that the sheets/panels overlap as previously described, allowing water to flow from one panel to the next without being able to penetrate the area under the roofing panel. As a first line of defense against water damage, it is important that the metal roof overlap be implemented correctly. The majority of the metal sheets 18 will go onto the roof whole and intact. As you near the edges of the roof or any points where the roof has gables, you may need to cut the sheets 18 to custom fit the space. Furthermore, while the sheets 18 may be made of metal, they may also be made of plastic or plastic-like material such as polyvinyl chloride (PVC) or the like.

I claim:

1. A roofing system for attachment to a framework of a building, comprising:

(a) a plurality of panels, said panels having left and right edges, wherein said left and right edges are sized and shaped to mate to each other;

(b) wherein said right edge has a raised portion consisting of a downwardly extending lower right leg and a lower right foot which terminates as a free end, and said left edge has a raised portion consisting of a downwardly extending lower left leg and a lower left foot which terminates as a free end;

(c) wherein said panels overlap on said left and right edges to form a hollow ridge, a first ridge being disposed on said left edge and a second ridge being disposed on said right edge, each said ridge being wider at the top than at the bottom and having a concave surface proximate said bottom;

(d) a plurality of upstanding ribs disposed in a spaced apart relationship in the non-overlapping flat portion of the panels between said first and second ridges, each said rib being wider at the top than at the bottom and having a concave surface proximate to said bottom;

(e) a plurality of caps disposed on each said ridge to prevent leakage of water through said panel; and (f) each said cap having a top, a left leg and a right leg, wherein each leg has an inset on a distal end being inset toward said opposite leg, wherein said inset is convex shaped and mated to said concave surface on said ridges and wherein insets are resiliently biased toward each other so that said caps are removably secured to said ridges to provide a water-proof seal.

2. The roofing system of claim 1, wherein said ridges and ribs have an end with an opening, further comprising an end cap being slidably inserted into said opening of said ridges and said ribs to water-proof said opening.

3. The roofing system of claim 1, wherein said cap has a shape selected from the group consisting of a flat cap, a hat cap, or an oval cap.

4. The roofing system of claim 1, wherein said insets are resiliently biased toward each other an effective amount so that said caps are removably secured to said ridges to provide a waterproof seal.

5. The roofing system of claim 1, wherein said first and second ridges each have a leg forming an acute angle with a horizontal plane, said acute angle ranging from about 40 degrees to eighty degrees.

6. The roofing system of claim 5, wherein said acute angle is about sixty degrees.

7. The roofing system of claim 1, wherein said inset is about ⅛ inch to about ½ inch long.

8. The roofing system of claim 1, further comprising a laterally extending foot on said right edge of said panel to prevent said ridge from crumpling when a fastener is inserted through said ridge.

9. A method for roofing, the resulting roof for attachment to a framework of a building, comprising the steps of:

(a) providing a plurality of panels, the panels having left and right edges, wherein the left and right edges are sized and shaped to mate each other, wherein said right edge has a raised portion consisting of a downwardly extending lower right leg and a lower right foot which terminates as a free end, and said left edge has a raised portion consisting of a downwardly extending lower left leg and a lower left foot which terminates as a free end, and wherein a plurality of upstanding ribs are disposed in a spaced apart relationship in the non-overlapping flat portion of the panels between said first and second ridges, each said rib being wider at the top than at the bottom and having a concave surface proximate to said bottom;

(b) forming a hollow ridge by overlapping the panels on the left and right edges, a first ridge being disposed on the left edge and a second ridge being disposed on the right edge, each ridge being wider the top than at the bottom and having a concave surface proximate the bottom;

(d) disposing a cap on each ridge to prevent leakage of water through the panel; and (d) wherein each cap has a top, a left leg and a right leg, wherein each leg has an inset on a distal end being inset toward the opposite leg, wherein the inset is convex shaped to mate to the concave surface on the ridges, and wherein the insets are resiliently biased toward each other so that the caps are removably secured to the ridges to provide a waterproof seal.

10. The method of claim 9, wherein the ridges and ribs have an end with an opening therein, further comprising an end cap for being slidably inserted into the opening of the ridges and the ribs to water-proof the opening.

11. The method of claim 9, wherein the cap has a shape selected from the group consisting of a flat cap, a hat cap, or an oval cap.

12. The method of claim 9, wherein the inserts are resiliently biased toward each other an effective amount so that said caps are removably secured to said ridges to provide a waterproof seal.

13. The method of claim 9, wherein each ridge has a leg forming an acute angle with a horizontal plane, said acute angle ranging from about forty degrees to about eighty degrees.

14. The method of claim 13, wherein the acute angle is about sixty degrees.

15. The method of claim 9, wherein said inset is about ⅛ inch to about ½ inch long.

16. The method of claim 9, further comprising the step of providing a laterally extending foot on said right edge of said panel to prevent said ridge from crumpling when a fastener is inserted through said ridge.

* * * * *